United States Patent [19]

Rule

[11] 4,324,654

[45] Apr. 13, 1982

[54] RECOVERY OF COPPER FROM COPPER OXIDE MINERALS

[75] Inventor: William T. Rule, Hibbing, Minn.

[73] Assignee: The Hanna Mining Company, Cleveland, Ohio

[21] Appl. No.: 950,859

[22] Filed: Oct. 12, 1978

[51] Int. Cl.[3] ..... B03D 1/02

[52] U.S. Cl. ..... 209/166; 252/61

[58] Field of Search ..... 209/166; 252/61; 75/10, 75/12

[56] References Cited

U.S. PATENT DOCUMENTS

| | | | |
|---|---|---|---|
| 3,438,494 | 4/1969 | Fuerstenau | 209/166 |
| 4,022,686 | 5/1977 | Arakatsu | 209/166 |
| 4,130,415 | 12/1978 | Negavas | 209/166 |

FOREIGN PATENT DOCUMENTS

| | | | |
|---|---|---|---|
| 2355065 | 1/1978 | France | 252/61 |
| 381398 | 6/1971 | U.S.S.R. | 209/166 |

OTHER PUBLICATIONS

Danilova, E. V. et al, Obogoschemie Rud., vol. 20, No. 3, pp. 1–10, (1975).

Gutzet, 6, Chelate Forming Compounds as Flot Reagents, TAIME, vol. 169, pp. 272–286, (1946).

*Primary Examiner*—Robert Halper

*Attorney, Agent, or Firm*—Maky, Renner, Otto & Boisselle

[57] ABSTRACT

A method of recovering copper from ores containing copper as atacamite/paratacamite by froth flotation is described which comprises utilizing as a collecting or flotation agent, a combination of two chelating agents having the formula $$R—C(OH)=N—OR^1$$

and $$R^2OCSSX$$

wherein R is an aliphatic or aromatic group containing from 5 to 10 carbon atoms, $R^1$ is hydrogen or an alkali metal, $R^2$ is an alkyl group containing up to 10 carbon atoms, and X is an alkali metal.

The method of the invention is useful in treating copper ores containing very small percentages by weight of copper.

6 Claims, No Drawings

RECOVERY OF COPPER FROM COPPER OXIDE MINERALS

BACKGROUND OF THE INVENTION

This invention relates generally to a process of recovering copper from ores containing copper as oxides, and more particularly, the invention relates to a process for recovering copper from ores containing atacamite/-paratacamite utilizing a novel combination of flotation agents for the copper.

Copper minerals in the oxidized zone of porphyry copper deposits are categorized broadly as copper "oxides". These oxides include atacamite/paratacamite [$Cu_2(OH)_3Cl$], azurite/malachite [$Cu_3(CO_3)_2(OH)_2$-/$Cu_2(CO_3)(OH)_2$], chrysocolla [$CuSiO_3.nH_2O$], cuprite [$Cu_2O$], etc. The copper minerals in the underlying sulfide rich and primary sulfide zones include chalcocite [$Cu_2S$], chalcopyrite [$CuFeS_2$], and bornite [$Cu_5FeS_4$].

One commonly used method for concentrating copper sulfide minerals utilizes a froth flotation circuit utilizing known sulfide collectors. However, the normally used collectors for sulfide minerals generally will not react upon the "oxide" copper minerals, and, hence, the recovery of copper from the copper oxide minerals often requires treatment steps which are different from those used with the sulfide ores.

Xanthates have been described as collectors for copper in froth-flotation procedures, but not all copper ores respond favorably to the xanthate collectors. U.S. Pat. No. 3,901,450 describes a flotation process for copper from ores containing copper sulfides wherein the suspension is conditioned in the presence of an alkaline agent and an alkali metal xanthate at a pH of from about 9.5 to about 12 and thereafter conditioned in the presence of selected dispersing agents and flocculating agents. U.S. Pat. No. 3,667,690 also describes a process for flotation of sulfide minerals from their ores utilizing two or more conditioning steps prior to the froth flotation step, and one of the conditioning steps utilizes a member of the xanthate family of flotation reagents and a dispersing agent.

The recovery of chrysocolla and iron oxide minerals from their ores by flotation utilizing hydroxamic acids as chelating agents for the copper is described in U.S. Pat. No. 3,438,494. The combination of hydroxamic derivatives such as potassium octylhydroxamate with amyl xanthate is disclosed as being useful although the inventors found that the copper minerals floated with the use of the hydroxamate alone.

SUMMARY OF THE DISCLOSURE

In accordance with the present invention, the recovery of copper from oxidized copper deposits containing atacamite/paratacamite is improved by utilizing a particular combination of collectors or flotation agents when conditioning a slurry of copper ore. This combination comprises a hydroxamic acid or alkali metal hydroxamate and an alkali metal xanthate.

DESCRIPTION OF THE PREFERRED EMBODIMENTS

The froth flotation process of this invention for separating and recovering copper from ores containing copper as atacamite/paratacamite generally comprises frothing said ore in the presence of a small amount of a combination of chelating agents, preferably in an aqueous medium having a pH within a range of from about 8 to about 9.5.

The copper-containing ores which are treated in accordance with the method of the invention are the ores broadly characterized as copper oxide ores, and more particularly, are ores wherein the copper is present principally as atacamite/paratacamite generally represented by the formula $Cu_2(OH)_3Cl$. Such ores generally are found in the oxidized zone of porphyry copper deposits. Two ore samples from Arizona which have been treated with the flotation method of the invention have been analyzed and the results of the analysis are reported below in Table I.

TABLE I

| | % Weight Analysis | | | | |
|---|---|---|---|---|---|
| Ore Sample No | Total Copper | Oxide Copper | Sulfide Copper | Cl | S |
| 1 | 1.77 | 1.67 | 0.10 | 0.41 | 0.05 |
| 2 | 1.54 | 1.17 | 0.37 | 0.22 | 0.30 |

Approximately 80% of the copper in Ore Sample No. 1 occurs as atacamite/paratacamite. The balance of the copper mineralization in Ore Sample No. 1 is chrysocolla, cuprite, native copper, copper pitch, copper montmorillonite and various sulfides. Approximately 50% of the copper present in Ore Sample No. 2 is present as atacamite/paratacamite, the balance of the copper mineralization being in the form of chrysocolla, cuprite, native copper, copper montmorillonite, copper pitch and copper sulfides, principally chalcocite. The copper minerals in both ore samples represent a very small percentage by weight of the weight of the ore, and it is highly desirable therefore to concentrate these copper values in a small weight.

It has been found in accordance with the method of the invention that the flotation and recovery of copper from such ores is improved when a particular combination of flotation agents is used to condition the suspension prior to formation of the froth. These flotation agents are chelating agents, and the first chelating agent is characterized by the formula $$R—C(OH)=N—OR^1 \qquad \text{(Formula I)}$$

wherein R is an aliphatic or aromatic group containing from 5 to 10 carbon atoms and $R^1$ is hydrogen or an alkali metal. Compounds of the type represented by Formula I are known as hydroxamic acids and alkali metal salts of such acids which also may be represented by the tautomeric formula $$R—C(O)—N(H)OR^1 \qquad \text{(Formula Ia)}$$

However, for the purposes of this application and the claims, the hydroxamic acids and salts will be represented by Formula I.

The preferred alkali metal salts are the potassium or sodium salts because of their favorable water solubility properties. Although the hydroxamic acids are effective, the alkali metal salts generally are preferred because of the favorable water solubility. A preferred example of the hydroxamic acid salt utilized in the method of the invention is potassium octyl hydroxamate which is a commercially available material in which the alkyl group may be a combination of heptyl and nonyl.

The second chelating agent used as a flotation agent in the method of the invention is represented by the formula $R^2OCSSX$ (Formula II)

wherein $R^2$ is an alkyl group containing up to about 10 carbon atoms and X is an alkali metal. Of the alkali metals, sodium and potassium are preferred. The chelating agents represented by Formula II above which are referred to as xanthates are readily available materials and examples include potassium ethyl xanthate, sodium isopropyl xanthate, potassium amyl xanthate, potassium sec-butyl xanthate, etc.

The method of the invention which utilizes the above described combination of chelating agents for recovering copper from ores containing copper as atacamite/-paratacamite comprises generally the steps of (a) preparing an aqueous slurry of the ore,
(b) adjusting the pH of the slurry to the desired value,
(c) adding to the slurry a first chelating agent represented by Formula I above and a second chelating agent represented by Formula II above,
(d) adding a frothing agent,
(e) agitating the mixture to form a froth containing the copper,
(f) removing the froth, and
(g) recovering the floated copper from the froth.

The slurry which is prepared and used in the method of the invention is made up from an ore which has been comminuted by grinding in a grinding mill of any standard type where the ore is mixed with water and ground to the desired particle size. Generally, the grinding mill will contain forged steel balls to produce a preferred particle size of approximately 97%–100 mesh. Conditioning agents may be added to the grinding mill prior to the grinding of the crude ore. The amount of water contained in the grinding mill may be varied depending on the desired solids content of the slurry. Solids of contents of from about 60 to 70% are preferred in the grinding operation. The slurry obtained in this manner may be used directly or may be filtered and dried to ease handling. If filtered, the residue may be repulped with water in a Fagegren flotation cell.

The pH of the aqueous slurry prepared in accordance with the above procedure can be adjusted to from about 6 to 12. A preferred range of pH for the aqueous slurry is from 8.0 to about 9.5.

After the pH of the slurry has been adjusted to the desired value, the combination of chelating agents is added to the slurry. Relatively small amounts of the chelating agents are effective in promoting the flotation of the copper minerals, and these amounts can be readily determined by one skilled in the art. Generally, the total amount of combined chelating agent may be varied from as little as 0.1 to as much as about 2.5 lb. of agent per ton of ore. The weight ratio of the chelating agent represented by Formula I to chelating agent represented by Formula II may vary from about 1:3 to about 3:1 although the presently preferred ratio is 1:2. After the chelating flotation agents have been added to the slurry, the slurry is conditioned for up to about 30 minutes and one or more frothing agents are added as required to form a suitable froth.

The frothing agents generally are incorporated in amounts ranging from about 0.001 to about 0.2 lb. per ton of ore in the slurry. Pine oil, cresylic acid, various alcohols such as amyl alcohol and soaps are typical frothing agents. Frothing agents are heteropolar organic compounds which reduce surface tension by being absorbed at air-water interfaces and thus facilitate formation of bubbles and froth. Two such commercially available frothing agents are "Dowfroth" produced by the Dow Chemifcal Company and methylisobutyl carbinol (MIBC). Various combinations of these materials often are used as frothing agents.

Following the addition of the frothing agents, the slurry is agitated with air to form a froth which is collected until depleted. The desired copper minerals are recovered from the froth.

The effectiveness of the chelating agents as flotation agents for ores containing copper as atacamite/-paratacamite is demonstrated in the following examples carried out on the ores obtained from Arizona identified above in Table I. Unless otherwise indicated, all parts and percentages are by weight. Weights reported as lb/T indicate weight of reagent in pounds per ton of crude ore.

EXAMPLE 1

The ore identified as ore No. 1 in Table I wherein approximately 80% of the copper occurs as atacamite/-paratacamite is ground in a steel mill with forged steel balls and tap water at about 65% solids to a powder of about 97%–100 mesh. The slurry is filtered, transferred to a Fagegren flotation cell and repulped with tap water at about 35° C. The pH of the slurry is adjusted with a base to about 8.7. Potassium octylhydroxamate 0.4 lb/T) and potassium amyl xanthate (0.8 lb/T) are added and the slurry is conditioned for twenty minutes. After conditioning, a small amount of a frothing agent comprising a 1:1 ratio of pine oil and methylisobutyl carbinol (MIBC) is added as required. Air is admitted into the slurry gradually to develop a froth which is collected in a pan. When the addition of frothing agent no longer produces froth, the air is turned off and the desired copper mineral is recovered from the froth.

For purposes of comparison, the above procedure is repeated except that in control example A, 0.4 lb/T of potassium octyl hydroxamate is used as the only chelating agent and the pH of the slurry is 9.2. In control example B, 0.5 lb/T of potassium amyl xanthate is used as the only chelating agent and the slurry is at a pH of about 9.0.

The results which are obtained from the above example of the invention and the control examples are summarized in the following Table II.

TABLE II

| | | | Assay % | | | | % Distrubution | | | |
|---|---|---|---|---|---|---|---|---|---|---|
| | Product | % Wt. | Total Cu | Ox Cu | S Cu | Cl | Total Cu | Ox Cu | S Cu | Cl |
| Example 1 | Concentrate | 20.92 | 6.88 | 6.52 | 0.36 | 1.62 | 83.87 | 84.35 | 76.04 | 97.94 |
| | Tailing | 79.08 | 0.35 | 0.32 | 0.03 | 0.009 | 16.13 | 15.65 | 23.96 | 2.06 |
| Control A | Concentrate | 14.31 | 3.60 | 3.20 | 0.40 | 0.62 | 28.34 | 26.79 | 52.68 | 25.04 |
| | Tailing | 85.69 | 1.52 | 1.46 | 0.06 | 0.31 | 71.66 | 73.21 | 47.32 | 74.96 |
| Control B | Concentrate | 3.43 | 7.36 | 5.90 | 1.46 | 1.23 | 14.13 | 11.92 | 56.48 | 12.02 |

TABLE II-continued

| Product | % Wt. | Assay % Total Cu | Ox Cu | S Cu | Cl | % Distrubution Total Cu | Ox Cu | S Cu | Cl |
|---|---|---|---|---|---|---|---|---|---|
| Tailing | 96.57 | 1.59 | 1.55 | 0.04 | 0.32 | 85.87 | 88.08 | 43.52 | 87.98 |

EXAMPLE 2

The procedure of Example 1 is repeated except that the potassium amyl xanthate is replaced by 0.8 lb/T of sodium isopropyl xanthate.

EXAMPLE 3

The procedure of Example 1 is repeated except that 0.4 lb/T potassium octylhydroxamate and 0.4 lb/T of potassium amyl xanthate are added to the slurry.

The experiments which have been carried out indicate that chelating agents of the type represented by Formula I and Formula II do not perform satisfactorily as flotation agents for extracting copper from ores containing copper as atacamite/paratacamite. However, as demonstrated in Example 1, the combination of these two chelating agents provides excellent recoveries of copper from such ores.

The embodiments of the invention in which an exclusive property or privilege is claimed are defined as follows:

1. A method of recovering copper from ores containing copper as atacamite/paratacamite by flotation which comprises (a) preparing a slurry of the ore in water, (b) adjusting the pH of the slurry to the desired value, (c) adding to the slurry a first chelating agent having the formula $$R—C(OH)=N—OR^1 \quad \text{(Formula I)}$$

and a second chelating agent having the formula $$R^2OCSSX \quad \text{(Formula II)}$$

wherein

R is an aliphatic or aromatic group containing from 5 to 10 carbon atoms, $R^1$ is hydrogen or an alkali metal, $R^2$ is an alkyl group containing up to 10 carbon atoms, and X is an alkali metal, (d) adding a frothing agent to the slurry, (e) agitating the slurry to form a froth containing the floated copper, (f) removing the froth, and (g) recovering the floated copper from the froth.

2. The method of claim 1 wherein the pH of the slurry is maintained between about 8.0 and 9.5.

3. The method of claim 1 wherein R in Formula I is an aliphatic group containing from 5 to 10 carbon atoms and $R^1$ is an alkali metal.

4. The method of claim 1 wherein $R^2$ is an alkyl group containing from 1 to 5 carbon atoms.

5. The method of claim 1 wherein the chelating agent represented by Formula I is potassium octyl hydroxamate.

6. The method of claim 5 wherein the chelating agent of Formula II is potassium amyl xanthate.

* * * * *